US005261636A

United States Patent [19]

Hawes, Jr. et al.

[11] Patent Number: 5,261,636

[45] Date of Patent: Nov. 16, 1993

[54] HANGING LAMINATED FOLDER

[75] Inventors: Robert E. Hawes, Jr., Huntington Bay; Cheryl Dellacroce, Baldwin; Eric Aaldenberg, Bayside, all of N.Y.; James J. Lynch, Berkley Heights, N.J.

[73] Assignee: Esselte Pendaflex Corporation, Garden City, N.Y.

[21] Appl. No.: 769,001

[22] Filed: Sep. 30, 1991

Related U.S. Application Data

[63] Continuation of Ser. No. 483,094, Feb. 21, 1990, Pat. No. 5,066,045.

[51] Int. Cl.[5] ..... B42D 1/00; B65D 27/00; B65D 37/00

[52] U.S. Cl. ..... 281/45; 40/359; 281/51; 229/68 R; 493/947

[58] Field of Search ..... 281/45, 51; 493/947, 493/89; 40/359; 229/68 R

[56] References Cited

U.S. PATENT DOCUMENTS

| | | | |
|---|---|---|---|
| 2,291,724 | 8/1942 | Jonas | 129/16.7 |
| 3,779,393 | 12/1973 | Grundell | 211/126 |
| 3,933,294 | 1/1976 | Meeet al. | 229/1.5 R |
| 4,031,646 | 6/1977 | de Nouel | 40/359 |
| 4,053,057 | 10/1977 | Snowden | 211/126 |
| 4,284,227 | 8/1981 | Corey | 229/1.5 R |
| 4,523,776 | 6/1985 | Barber | 283/39 |
| 4,580,815 | 4/1986 | Barber | 283/81 |
| 4,749,121 | 6/1988 | Barber et al. | 229/1.5 R |
| 4,830,268 | 5/1989 | Pitts | 229/68 R |

FOREIGN PATENT DOCUMENTS

| | | |
|---|---|---|
| 563159 | 12/1957 | Belgium . |
| 630978 | 11/1963 | Belgium . |
| 1236472 | 3/1967 | Fed. Rep. of Germany . |
| 1463195 | 11/1966 | France . |
| WO90/03890 | 4/1990 | PCT Int'l Appl. . |

*Primary Examiner*—Paul A. Bell
*Attorney, Agent, or Firm*—Pennie & Edmonds

[57] ABSTRACT

A hanging folder has reinforcing strips along its top and bottom edges, and color contrasted easy-insert label slots. These strips and contrasting slots protect against wear to the folder and thus prolong the usefulness of the folder.

21 Claims, 1 Drawing Sheet

FIG. 1
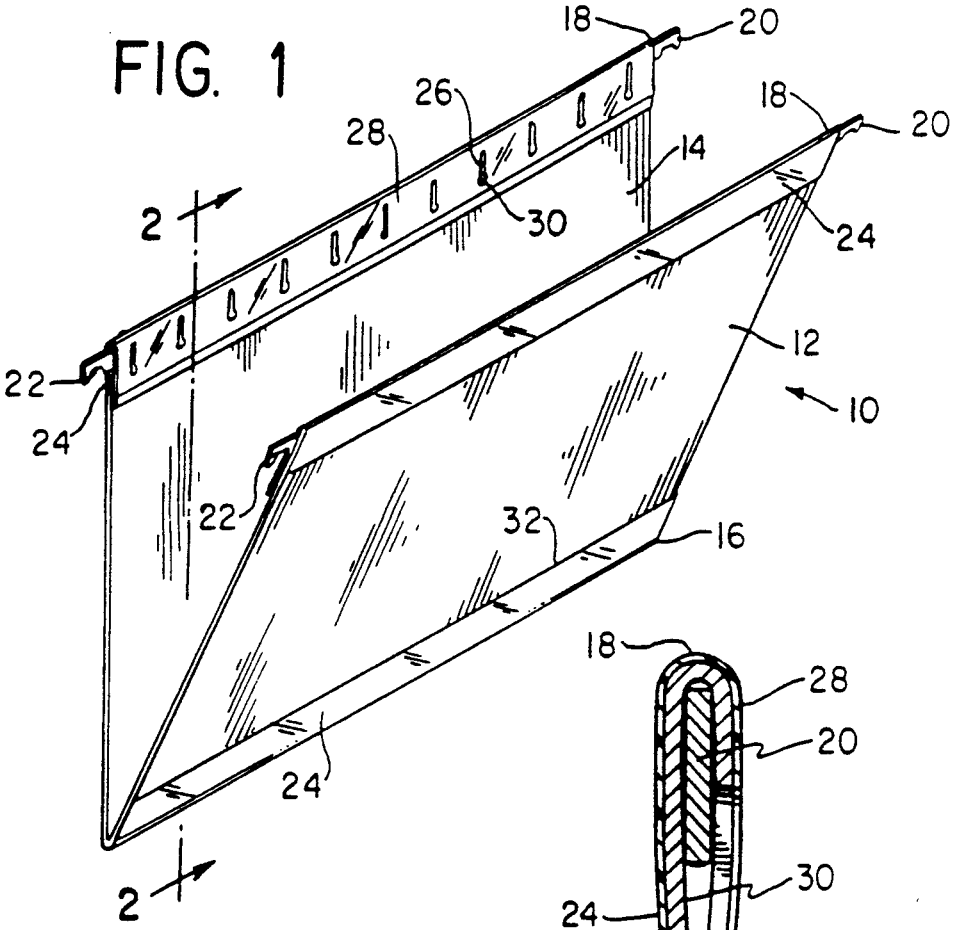
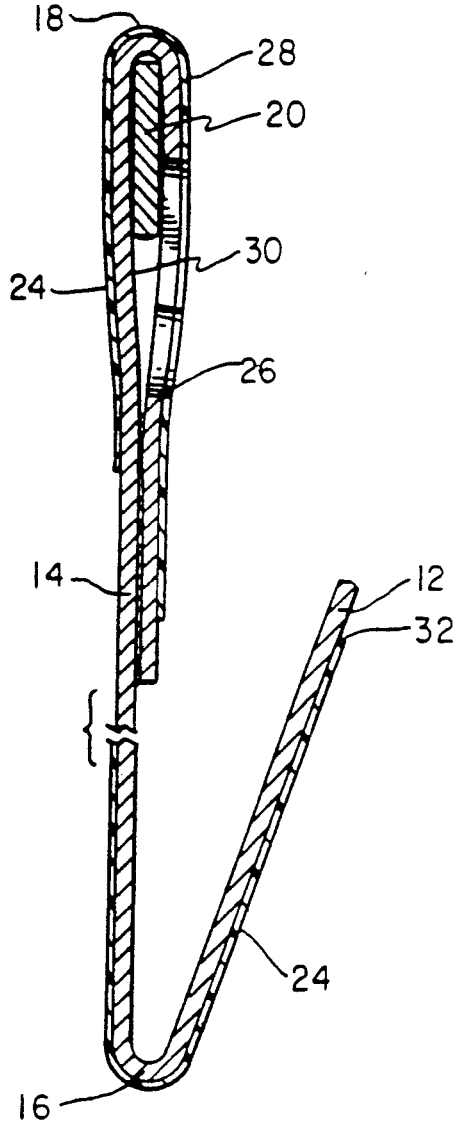
FIG. 2

HANGING LAMINATED FOLDER

This is a continuation, of application Ser. No. 07/483,094, filed Feb. 21, 1990 now U.S. Pat. No. 5,066,045.

TECHNICAL FIELD

The present invention relates to paper office supplies and, in particular, to hanging folders having laminated portions for increased strength, longer life and paper surface integrity.

BACKGROUND ART

Paper hanging folders, for use in standard storage units such as file cabinets, desk drawers and the like, are a necessary tool in modern offices and businesses. Such folders in the art are best exemplified by expired Pat. No. 2,291,724, which was assigned to the assignee of the present application. This reference describes a file formed by a sheet of heavy material with a central horizontal fold which forms the folder's bottom and open sides. Folds are provided in the file's top edges through which hanging rods are movably or immovably fixed. The ends of these rods are exposed and notched, enabling the file to hang on a complementary standard parallel file frame in office storage equipment, such as filing cabinets and desk drawers.

The inner surfaces at the tops of the folded-over portions contain uniformly spaced slots for insertion of labeling tabs. These slots often tear or wear out as new tabs are inserted or removed, due to the need for frequent file relabeling or repositioning of labels in alternative slots of the file. Also, when the user inserts the tabs of the label into the slots, close attention is required because the opening of the slot and the material behind it are generally identical in color. Due to the wear and tear on tab slots, files are often replaced simply because the tab slots are torn or worn out, rendering the file useless. Also, handling during normal use and tab changing causes additional wear on the top of the file due to the release of body oils and friction between the paper and fingers. This type of wear is not diminished by the rods disposed through the file's top folds, because finger oils and friction break down the material of the file, which is generally paper, regardless of the underlying support of the rod.

U.S. Pat. No. 4,749,121 discloses a hanging folder with a reinforcing plastic film applied to the side edges to reduce wear on the side of the file as it is moved in the frame. This film may be applied with colored adhesive to provide a color coding system or a clear film may be applied over a colored surface by a clear adhesive to achieve the same result. Similar side reinforcing techniques are disclosed in U.S. Pat. Nos. 4,523,776 and 4,580,815.

When hanging files are filled with a large volume of paper, the sides tend to spread away from each other and the bottom lifts. However, the present inventor has learned that when the file holds a narrow heavy object, the bottom of the file drags along the bottom of the drawer or other container for the frame, leading to wear and tear on the bottom of the file. This necessitates file replacement before the body of the file has worn out.

It is clear that a need exists for a hanging folder file which has a strong bottom to hold the weight of its contents and to guard against wear due to its being dragged along the bottom of a drawer. Also, a reinforced top edge is needed to guard against wear from handling and the insertion of tabs. A need further exists for a folder which makes tab insertion easy and faster than folders of the prior art now allow.

SUMMARY OF THE PRESENT INVENTION

The present invention is directed to hanging folders formed by folding a sheet of heavy duty paper along one or more medial lines which form the folder's bottom. The outside of the lower surface of the bottom of the folder has a laminated strip across its entire length. The top edges of the paper are folded over and glued down to the inside of the file and provide openings for hanging rods from which the folder is suspended on a standard file frame in office storage equipment. The inner surfaces of the top folds have slots for insertion of labelling tabs. If the outside and inside surface of the sheet are of different colors, the inside of the front and rear faces below the folded down portion will be of a contrasting color to the rest of the file. This color contrast is visible through the tab slots.

If desired, a reinforcing strip may be laminated over the upper part of the front and rear surfaces of the file. This strip may extend over the top of the front and rear surfaces and down to the lower edge of the folded over portion.

Folders formed according to the present invention give at least three advantages to the user. First, the bottom of the folder is laminated to prevent tearing and wear from the weight of the file's contents, and scraping of the file along the bottom of a drawer. Second, the color contrast between the area surrounding the tab slots and the area behind the slots enables quick and easy visual location of the slots for easy insertion of tabs, thus leading to less effort on the part of the user and less wear and tear on the tabs and slots. Third, the outer and inner top edges of the file, except the tab slots, are also covered with a laminate to decrease wear and tear from normal handling and tab insertion. All of these advantages add to the durability of the file's top and bottom, prolonging its usefulness.

BRIEF DESCRIPTION OF THE DRAWINGS

The foregoing and other features of the present invention will be more readily apparent from the following detailed description and drawings of an illustrative embodiment of the invention in which:

FIG. 1 shows a perspective view of a hanging folder of the present invention having reinforcing top and bottom laminated strips and color contrasted label slots; and FIG. 2 shows a right side sectional view (partially broken) of the hanging folder of FIG. 1 along line 2—2.

DESCRIPTION OF THE PREFERRED EMBODIMENTS

FIG. 1 shows a hanging folder 10 having a front portion 12, and a rear portion 14 connected along one or more medial folds 16. Folder 10 may be made of colored paper, plastic and film. At the upper edges of the front and rear portions there are terminal folds 18 which, on the inside of the file, define slots for tabs and through which hanging rods 20 are disposed, as shown in FIG. 2. The end portions of each hanging rod 20 have notches 22 which are complementary to a standard filing frame in office storage equipment, enabling the file to hang while stored, e.g. in a file drawer. The outer surface of the folder in the area of the medial fold 16 and the terminal folds 18 are covered by a reinforcing strip plastic material 24 which is preferably laminated thereto. These strips prolong the life of the file.

This lamination 24, the placement of which is shown in detail in FIG. 2, protects against frequent handling at the terminal edges of the file, strengthens the file's bottom, and protects the bottom of the file when it is dragged along a file drawer bottom while carrying the weight of narrow stored papers and other items.

The only portions of the file's terminal fold not covered by lamination are the shaped slots 26, through which labels, visible as the file hangs in a standard storage unit, are inserted.

In a preferred embodiment, the color of the inner surfaces of the material from which the file is made differ from the color of the outer surfaces. As a result, the slotted portion of the laminated edge 28 contrasts with the color of the inside portion of the file 30 and is visible through the slots 26. This color contrast makes visual location of the slot and insertion of new tabs into the slot easier. Easier insertion results in less contact with the portion surrounding the slots 26, reduction in wear and prolonged usefulness life of the file 10. The lamination also makes it easier to punch the teardrop slots during manufacture of the folder.

Some embodiments may have a multiplicity of horizontal depressions 32 on the bottom edges of the file, which can be folded by the user to create additional medial folds to expand, i.e. square off, the file's bottom.

While the present invention has been particularly shown and described with reference to a preferred embodiment thereof, it will be understood by those skilled in the art that various changes in form and details may be made therein without departing from the spirit and scope of the invention.

I claim:

1. A hanging folder comprising:

a sheet of flexible material folded at a medial line to form a bottom edge with an exterior surface, and front and rear portions joined at the bottom edge, the ends of the front and rear portions remote from the bottom edge being folded to form top terminal folded portions;

uniformly spaced slots in at least one of the top terminal folded portions;

reinforcing means in the form of a strip of plastic material disposed along a major portion of the top terminal folded portion which has the slots therein and along a portion of said exterior surface adjacent thereto and forming a lamination therewith, wherein the reinforcement does not cover the slots; and means for hanging the folder on a standard filing frame in office storage equipment.

2. The hanging folder of claim 1 wherein the reinforcing means comprises a plastic material.

3. The hanging folder of claim 1 wherein the hanging means comprises two rods having notches complementary to a standard filing frame, the rods being disposed through the terminal folded portions on the top edges of the front and rear portions.

4. The hanging folder of claim 1 wherein the sheet of flexible material comprises colored paper, and the hanging means comprises rods.

5. The hanging folder of claim 1 wherein the bottom edge of the folder has at least one horizontal linear depression which provides a crease line for forming at least one additional medial line to allow for expansion of the bottom of the folder.

6. The hanging folder of claim 1 wherein the slots are positioned to receive label tabs therein.

7. A hanging folder comprising:

a sheet of flexible material folded at a medial line to form a bottom edge with an exterior surface, and front and rear portions joined at the bottom edge, the ends of the front and rear portions remote from the bottom edge being folded to form top terminal folded portions;

uniformly spaced slots in each top terminal folded portion;

first reinforcing means in the form of a strip of material disposed along a major portion of, and covering, the exterior surface of the bottom edge of the folder to increase the wear resistance, strength and life of the bottom edge; and second reinforcing means in the form of a strip of plastic material disposed along a major portion of the top terminal folded portions which have the slots therein and along a portion of the exterior surfaces adjacent said terminal portions, wherein the second reinforcing means does not cover the slots.

8. The hanging folder of claim 7 wherein the first reinforcing means comprises a plastic material.

9. The hanging folder of claim 7 wherein the sheet of flexible material comprises colored paper, and the hanging means comprises rods.

10. The hanging folder of claim 7 wherein the bottom edge of the folder has at least one horizontal linear depression which provides a crease line for forming at least one additional medial line to allow for expansion of the bottom of the folder.

11. The hanging folder of claim 7 wherein the slots are positioned to receive label tabs therein.

12. A hanging folder comprising:

a sheet of flexible material having interior and exterior surfaces and being folded at a medial line to form a bottom edge with a lower surface, and front and rear portions joined at the bottom edge, the edges of the front and rear portions remote from the bottom edge being folded over to form top terminal folded portions;

uniformly spaced slots in each top terminal folded portion; and reinforcing means in the form of a strip of plastic material disposed along a major portion of, and covering, each of the top terminal folded portions which have the slots therein and along a portion of the exterior surfaces adjacent to said terminal portions and forming a lamination therewith, wherein the reinforcing means does not cover the slots.

13. The hanging folder of claim 12 wherein the reinforcing means comprises a plastic.

14. The hanging folder of claim 12 wherein the slots are positioned to receive label tabs therein.

15. A hanging folder comprising:

a sheet of flexible material folded at a medial line to form a bottom edge with a lower surface, and front and rear portions joined at the bottom edge, the edges of the front and rear portions remote from the bottom edge being folded to form top terminal folded portions;

uniformly spaced slots in at least one of the top terminal folded portions;

rods complementary to a standard filing frame being disposed through the top terminal folded portions;

first reinforcing means disposed along a major portion of the exterior surface of the bottom edge of the folder to increase the wear resistance, strength and life of the lower surface of the bottom edge;

second reinforcing means in the form of a strip of plastic material disposed along a major portion of the top terminal folded portion that has the slots therein and along a portion of the exterior surfaces adjacent said terminal portions, wherein the second reinforcing means does not cover the slots.

16. The handing folder of claim 15 wherein the first reinforcing means comprises a plastic.

17. The hanging folder of claim 15 wherein the slots are positioned to receive label tabs therein.

18. A hanging folder comprising:

a sheet of flexible material folded at a medial line to form a bottom edge with an exterior surface, and front and rear portions joined at the bottom edge, the ends of the front and rear portions remote from the bottom edge being folded over to form top terminal folded portions;

hanging means for hanging the folder on a standard filing frame in office storage equipment, the hanging means comprising two rods having notches complementary to the standard filing frame, the rods being disposed through the terminal folded portions on the top edges of the front and rear portions;

uniformly spaced slots in at least one of the terminal folded portions for receiving label tabs, the slots being transverse to the medial line, the length of the slots being greater than the height of the rods, wherein an exterior surface of at least one of the front and rear portions of the folder has a color different than an interior surface of the folder such that the interior surface visible through the slots contrasts in color with the exterior surface of at least one of the front and rear portions which is folded over and in which the slots are formed; and reinforcing means in the form of a first strip of plastic material which covers at least one of the terminal folded portions, excluding the slots, and the adjacent outer surface top areas and edges of the corresponding one of the front and rear portions and forming a lamination therewith.

19. The handing folder of claim 18 wherein the reinforcing means covers both of the terminal folded portions, excluding the slots, and the top areas and edges of the corresponding front and rear portions.

20. The hanging folder of claim 19 wherein the reinforcing means includes a second strip of material disposed along a major portion of the bottom edge of the folder for increasing the wear resistance, strength, and life of the bottom edge, the strip covering the medial line and lower areas of the front and rear portions.

21. The hanging folder of claim 20 wherein the second strip of material is on the exterior surface of the bottom edge of the hanging folder.

* * * * *